US006667581B2

(12) United States Patent
Ahn

(10) Patent No.: US 6,667,581 B2
(45) Date of Patent: Dec. 23, 2003

(54) PLASMA DISPLAY PANEL

(75) Inventor: Young Joon Ahn, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/196,129

(22) Filed: Jul. 17, 2002

(65) Prior Publication Data

US 2003/0015967 A1 Jan. 23, 2003

(30) Foreign Application Priority Data

Jul. 18, 2001 (KR) ..... P2001-43081

(51) Int. Cl.[7] ..... G09G 3/10

(52) U.S. Cl. ..... 315/169.4; 315/69.1; 313/584; 313/581; 345/67

(58) Field of Search ..... 315/169.4, 169.1, 315/169.3; 313/581, 582, 584, 585, 586, 590; 345/55, 60, 67

(56) References Cited

U.S. PATENT DOCUMENTS 5,825,128 A * 10/1998 Betsui et al. ..... 313/582
5,952,783 A * 9/1999 Kuroki et al. ..... 313/590
6,252,353 B1 * 6/2001 Ha et al. ..... 313/582
6,295,040 B1 * 9/2001 Nhan et al. ..... 345/60
6,376,995 B1 * 4/2002 Kato et al. ..... 315/169.3
2002/0005822 A1 * 1/2002 Lee et al. ..... 345/60
2002/0047566 A1 * 4/2002 Kim et al. ..... 315/169.3
2003/0015964 A1 * 1/2003 Park et al. ..... 313/585

FOREIGN PATENT DOCUMENTS

KR 2000-32840 6/2000

* cited by examiner

*Primary Examiner*—Haissa Philogene
(74) *Attorney, Agent, or Firm*—Fleshner & Kim, LLP

(57) ABSTRACT

A plasma display panel that is adaptive for improving light-emission efficiency. In the plasma display panel, a plurality of electrode groups each has first and second electrodes formed adjacently to each other at an upper substrate and third electrodes having a large distance from the second electrodes. A plurality of address electrodes are formed at a lower substrate in a direction crossing the first to third electrodes. Barrier ribs are provided to form a discharge space between the upper substrate and the lower substrate. A dielectric layer is provided on the address electrode. A first area has a fluorescent layer formed on the dielectric layer. A second area other than the first area is defined.

22 Claims, 8 Drawing Sheets

PLASMA DISPLAY PANEL

BACKGROUND OF THE INVENTION

1. Field of the Invention

This invention relates to a plasma display panel, and more particularly to a plasma display panel that is adaptive for improving light-emission efficiency.

2. Description of the Related Art

Generally, a plasma display panel (PDP) is a display device utilizing a visible light emitted from a fluorescent body when an ultraviolet ray generated by a gas discharge excites the fluorescent body. The PDP has an advantage in that it has a thinner thickness and a lighter weight in comparison to the existent cathode ray tube (CRT) and is capable of realizing a high resolution and a large-scale screen. The PDP includes of a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell 1 of the conventional three-electrode, AC surface-discharge PDP includes a first electrode 12Y and a second electrode 12Z provided on an upper substrate 10, and an address electrode 20X provided on a lower substrate 18. Such a discharge cell 1 is arranged at a panel in a matrix type as shown in FIG. 2.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with fluorescent layers 26R, 26G and 26B. The address electrode 20X is formed in a direction crossing the first electrode 12Y and the second electrode 12Z. The barrier rib 24 is formed in parallel to the address electrode 20X to prevent an ultraviolet ray and a visible light generated by a discharge from being leaked to the adjacent discharge cells.

The fluorescent layers 26R, 26G and 26B are excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24. A black matrix 30 is formed between the first electrode 12Y and the second electrode 12Z which are provided at the adjacent discharge cells 1.

Such an AC surface-discharge PDP drives one frame, which is divided into various sub-fields having a different discharge frequency, so as to express gray levels of a picture. Each sub-field is again divided into an initialization period for uniformly causing a discharge, an address period for selecting the discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields SF1 to SF8 as shown in FIG. 2.

Each of the 8 sub-fields SF1 to SF8 is divided into an address period and a sustain period. Herein, the initialization period and the address period of each sub-field are equal every sub-field, whereas the sustain period is increased at a ration of $2^n$ (wherein n=0, 1, 2, 3, 4, 5, 6 and 7) at each sub-field. Since each sub-field has a different sustain period, it is able to express a gray scale of a picture.

In the reset period, a reset pulse is applied to the first electrode 12Y to cause a reset discharge. In the address period, a scanning pulse is applied to the first electrode 12Y and a data pulse is applied to the address electrode 20X, to thereby cause an address discharge between two electrodes 12Y and 20X. Upon address discharge, wall charges are formed at upper and lower dielectric layers 14 and 22. In the sustain period, an alternating current applied alternately to the first electrode 12Y and the second electrode 12Z generates a sustain discharge at the first electrode 12Y and the second electrode 12Z.

In such a conventional PDP, the red fluorescent layer 26R, the green fluorescent layer 26G and the blue fluorescent layer 26B are formed from a different material to thereby have a different dielectric constant. Accordingly, in order to generate a uniform address discharge at discharge cells, a driving voltage applied to each discharge should be set differently in consideration of dielectric constants of the fluorescent layers 26R, 26G and 26B.

However, in the conventional address period, all the discharge cells are supplied with a scanning pulse and a data pulse that have the same voltage level. Accordingly, dielectric constants of the red, green and blue fluorescent layers 26R, 26G and 26B cause a different address discharge is at each discharge cell. In other words, in the prior art, a uniformity of the discharge cell may be deteriorated, and an erroneous discharge may be generated in the sustain period due to wall charges formed differently for each discharge.

In order to compensate for the above-mentioned disadvantage, Korean Laid-open Patent Gazette No. 98-49446 has suggested a PDP as shown in FIG. 3.

Referring to FIG. 3, a three-electrode PDP according to another conventional embodiment includes a first electrode 34Y and a second electrode 34Z provided on an upper substrate 32, and an address electrode 42X provided on a lower substrate 40.

On the upper substrate 32 provided with the first electrode 34Y and the second electrode 34Z in parallel, an upper dielectric layer 36 and a protective film 38 are disposed. Wall charges generated upon plasma discharge are accumulated into the upper dielectric layer 36. The protective film 38 prevents a damage of the upper dielectric layer 36 caused by a sputtering during the plasma discharge and improves the emission efficiency of secondary electrons. This protective film 38 is usually made from magnesium oxide (MgO).

A lower dielectric layer 44 and barrier ribs 48 are formed on the lower substrate 40 provided with the address electrode 42X. The surfaces of the lower dielectric layer 44 and the barrier ribs 48 are coated with fluorescent layers 46R, 46G and 46B. The address electrode 42X is formed in a direction crossing the first electrode 34Y and the second electrode 34Z. The barrier rib 48 is formed in parallel to the address electrode 42X to prevent an ultraviolet ray and a visible light generated by a discharge from being leaked to the adjacent discharge cells.

The fluorescent layers 46R, 46G and 46B are excited by an ultraviolet ray generated during the plasma discharge to generate any one of red, green and blue visible light rays. An inactive gas for a gas discharge is injected into a discharge space defined between the upper and lower substrate 32 and 40 and the barrier rib 48.

In the PDP according to another conventional embodiment, a hole 50 is defined at an intersection between the address electrode 42X and the first electrode 34Y. Such a hole 50 is formed by removing the fluorescent layers 46R, 46G and 46B. Accordingly, an address discharge generated between the address electrode 42X and the first electrode 34Y is uniformly generated at all the discharge cells. In other words, since the fluorescent layers 46R, 46G and 46B are not formed at an intersection between the first address electrode 42X and the first electrode 34Y, an address discharge is generated irrespectively of dielectric constants of the fluorescent layers.

However, in the POP according to another conventional embodiment, since the fluorescent layers 46R, 46G and 46B are not formed at an intersection between the address electrode 42X and the first electrode 34Y, a light-emission efficiency of the sustain discharge generated between the first electrode 34Y and the second electrode 34Z is deteriorated. In other words, since the hole 50 is defined at a sustain discharge space, that is, since a coated area of the fluorescent body is reduced, it is impossible to excite the fluorescent body at a portion provided with the hole 50.

SUMMARY OF THE INVENTION

Accordingly, it is an object of the present invention to provide a plasma display panel that is adaptive for improving light-emission efficiency.

In order to achieve these and other objects of the invention, a plasma display panel according to one aspect of the present invention includes a plurality of electrode groups, each of which includes first and second electrodes formed adjacently to each other at an upper substrate and third electrodes having a large distance from the second electrodes; a plurality of address electrodes formed at a lower substrate in a direction crossing the first to third electrodes; barrier ribs provided to form a discharge space between the upper substrate and the lower substrate; a dielectric layer provided on the address electrode; a first area including a fluorescent layer formed on the dielectric layer; and a second area other than the first area.

In the plasma display panel, the second area is positioned at an intersection between the address electrode and the first electrode.

The second area has a large width than the address electrode.

The second area is defined from an intersection between the address electrode and the first electrode until the barrier ribs formed adjacently to the address electrode.

A black matrix is formed between the electrode groups.

The second area is defined from an intersection between the address electrode and the first electrode until the black matrix formed adjacently to the first electrode.

The second area has a larger width than the address electrode.

The second area is defined from an intersection between the address electrode and the first electrode until the barrier ribs formed adjacently to the address electrode.

A data pulse is applied to the address electrode and a scanning pulse is applied to the first electrode in an address period for selecting a cell to be turned.

A sustain pulse is alternately applied to the second electrode and the third electrode in a sustain period for discharging cells selected in the address period.

The fluorescent material is not formed at the second area.

A plasma display panel according to another embodiment of the present invention includes a plurality of first electrode groups, each of which includes first and second electrodes formed adjacently to each other at an upper substrate and third electrodes having a large distance from the second electrodes; a plurality of second electrode groups being adjacent to the first electrode groups and having first electrodes, second electrodes and third electrodes arranged in a mirror type with respect to the first electrode groups; a plurality of address electrodes formed at a lower substrate in a direction crossing the first to third electrodes; barrier ribs provided to form a discharge space between the upper substrate and the lower substrate; a dielectric layer provided on the address electrode; a first area including a fluorescent layer formed on the dielectric layer; and a second area other than the first area.

In the plasma display panel, the second area is positioned at an intersection between the address electrode and the first electrode.

The second area has a large width than the address electrode.

The second area is defined from an intersection between the address electrode and the first electrode until the barrier ribs formed adjacently to the address electrode.

A black matrix is formed between the first and second electrode groups.

The second area is positioned between the first electrodes formed adjacently with having the black matrix therebetween.

The second area has a larger width than the address electrode.

The second area is defined from an intersection between the address electrode and the first electrode until the barrier ribs formed adjacently to the address electrode.

A data pulse is applied to the address electrode and a scanning pulse is applied to the first electrode in an address period for selecting a cell to be turned.

A sustain pulse is alternately applied to the second electrode and the third electrode in a sustain period for discharging cells selected in the address period.

The fluorescent material is not formed at the second area.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
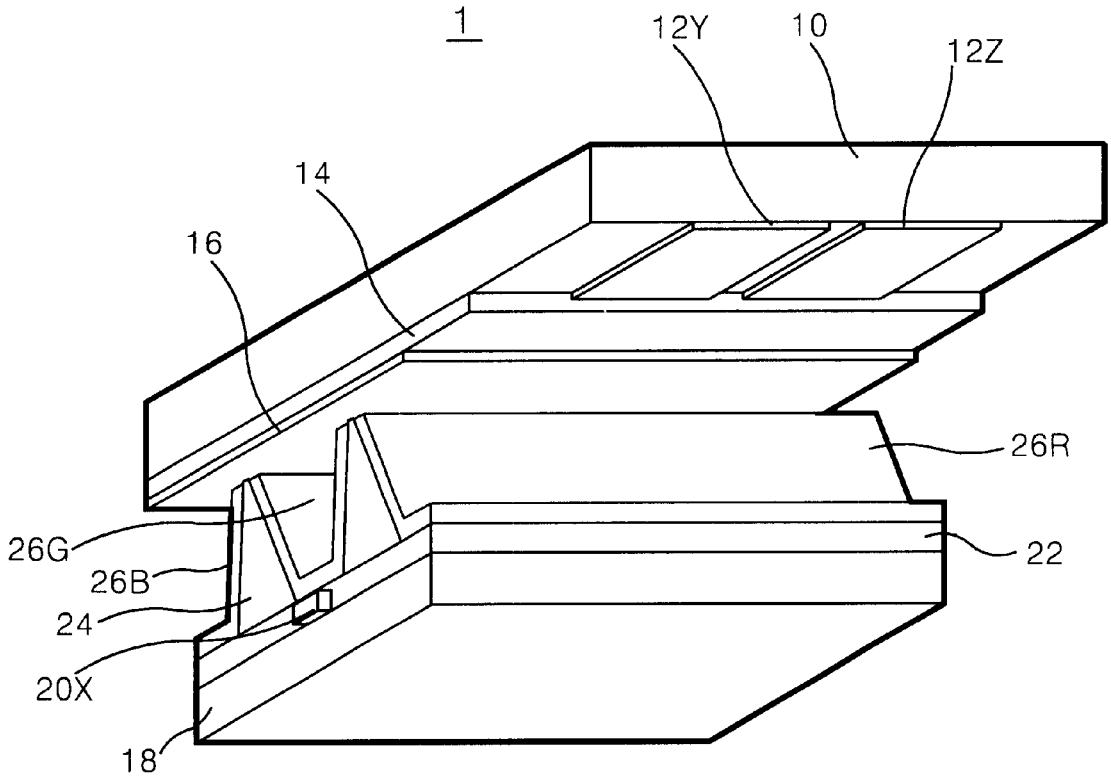
FIG. 1 CONVENTIONAL ART
FIG. 1 is a perspective view showing a conventional three-electrode AC surface-discharge plasma display panel.
Figure 2:
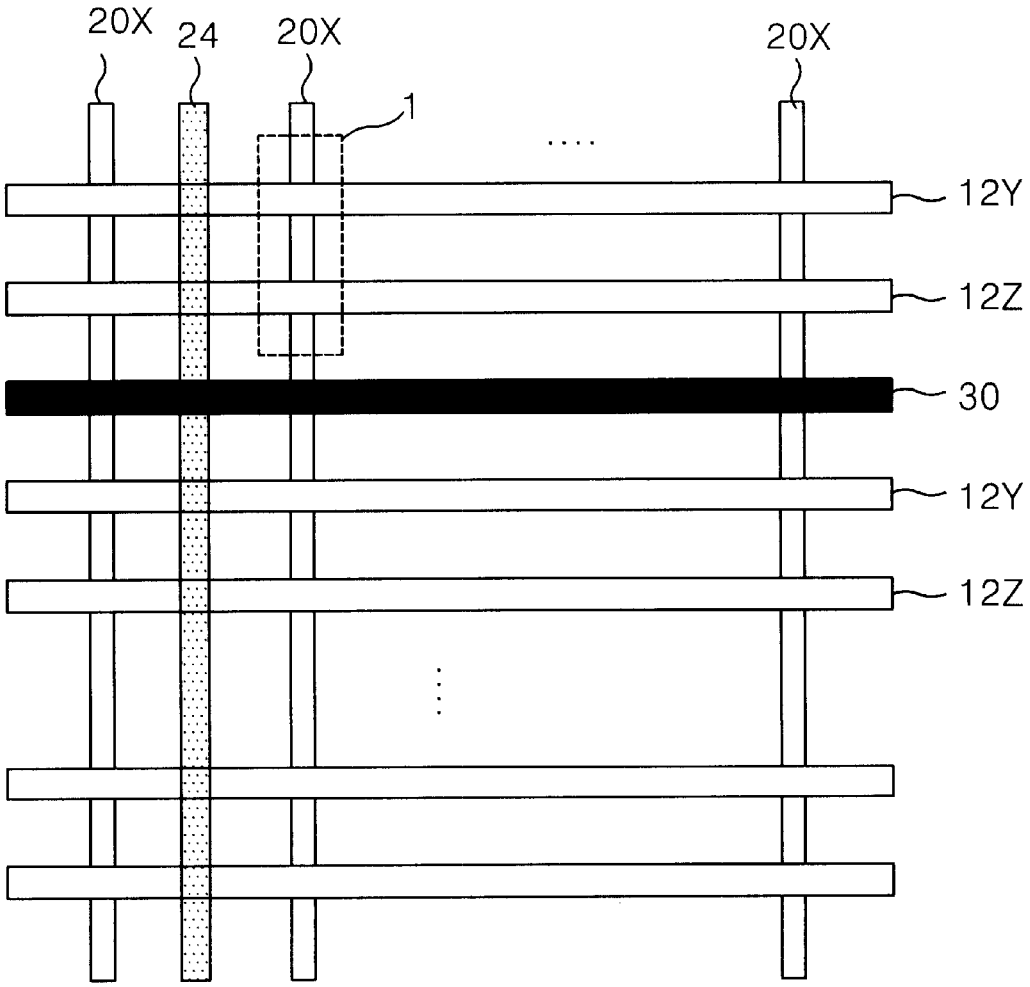
FIG. 2 CONVENTIONAL ART
FIG. 2 illustrates a discharge cell arrangement of the AC surface discharge plasma display panel shown in FIG. 1.
Figure 3:
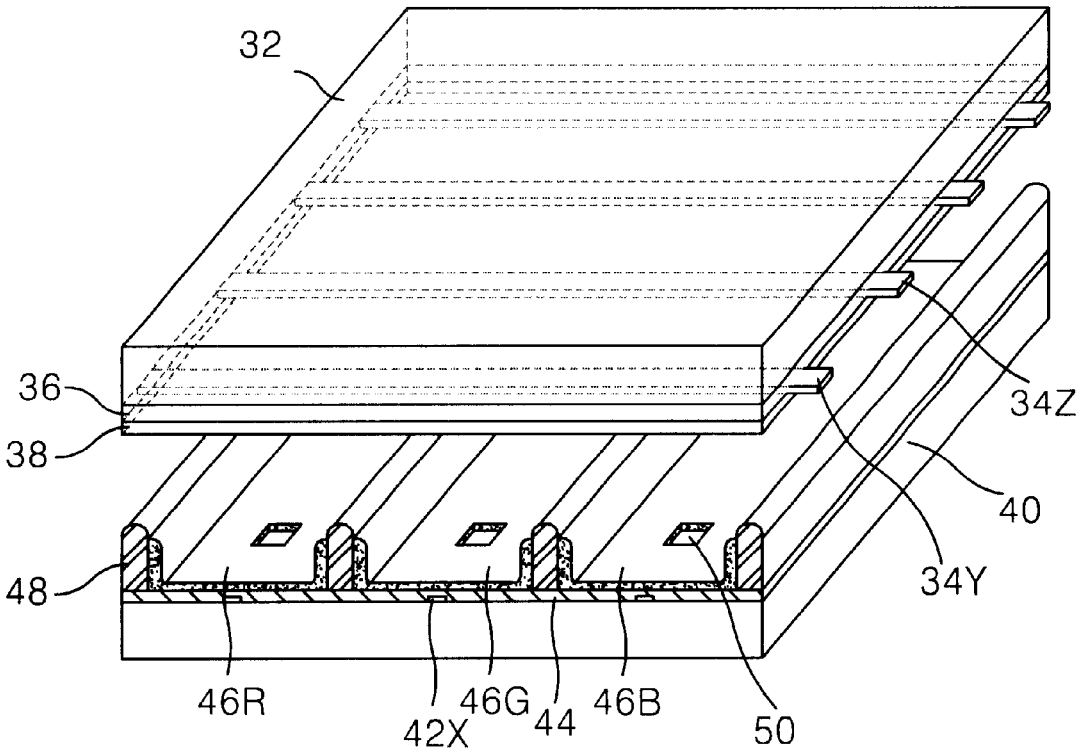
FIG.3 CONVENTIONAL ART
FIG. 3 is a perspective view showing a conventional three-electrode AC surface-discharge plasma display panel according to another embodiment.
Figure 4:
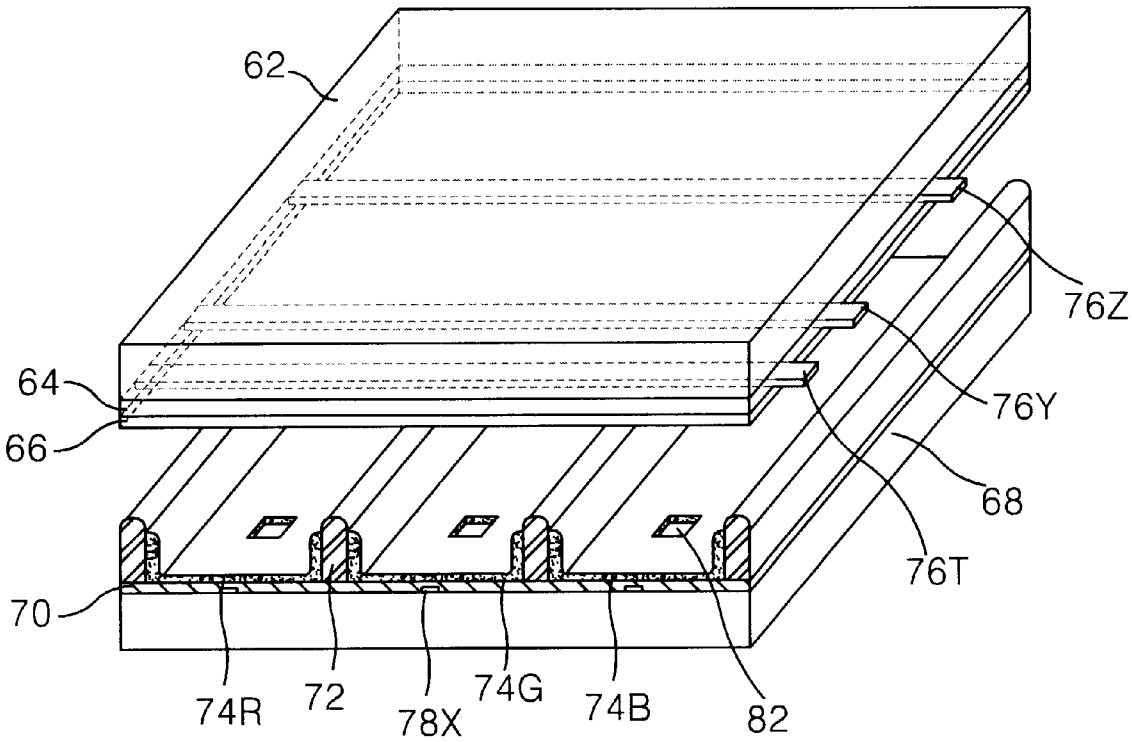
FIG. 4 is a perspective view showing a four-electrode AC surface-discharge plasma display panel according to an embodiment of the present invention.

Referring to FIG. 4, there is shown a four-electrode, alternating current (AC) surface-discharge PDP according to an embodiment of the present invention.

The PDP includes a first electrode 76T, a second electrode 76Y and a third electrode 76Z provided on an upper substrate 62, and an address electrode 78X provided on a lower substrate 68.

The first electrode 76T and the second electrode 76Y provided at the upper substrate 62 have a narrow gap while the third electrode 76Z has a wide gap from the second electrode 76Y. On the upper substrate 62 provided with the first to third electrodes 76T, 76Y and 76Z in parallel, an upper dielectric layer 64 and a protective film 66 are disposed. Wall charges generated upon plasma discharge are accumulated into the upper dielectric layer 64. The protective film 66 prevents a damage of the upper dielectric layer 64 caused by a sputtering during the plasma discharge and improves the emission efficiency of secondary electrons.

A lower dielectric layer 70 and barrier ribs 72 are formed on the lower substrate 68 provided with the address electrode 78X. The surfaces of the lower dielectric layer 70 and the barrier ribs 72 are coated with fluorescent layers 74R, 74G and 74B. The address electrode 78X is formed in a direction crossing the first electrode to third electrodes 76T, 76Y and 76Z. The barrier rib 72 is formed in parallel to the address electrode 78X to prevent an ultraviolet ray and a visible light generated by a discharge from being leaked to the adjacent discharge cells.

Figure 5:
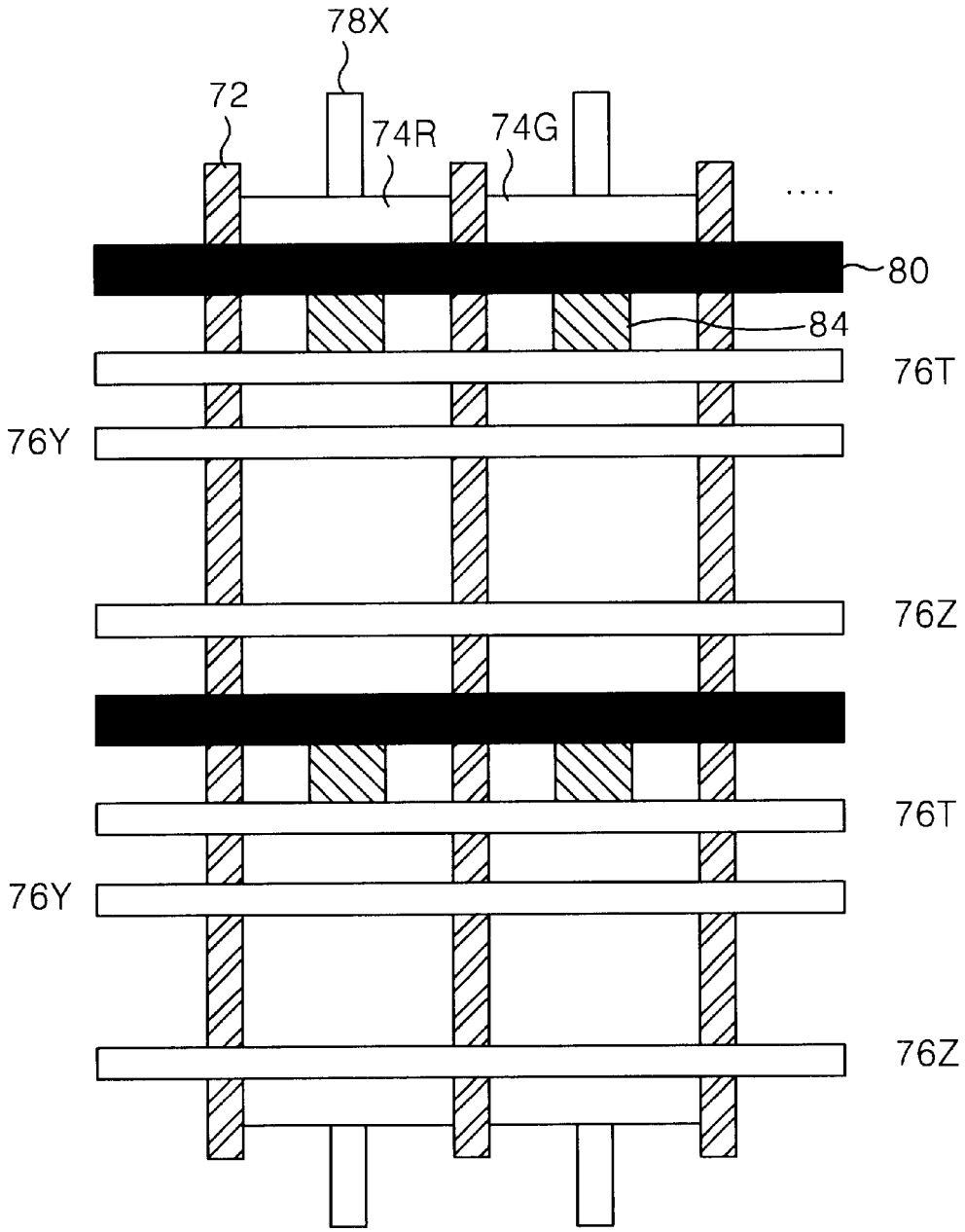
FIG. 5 illustrates other example of the hole shown in FIG. 4.

The fluorescent layers 74R, 74G and 74B are excited by an ultraviolet ray generated during the plasma discharge to generate any one of red, green and blue visible light rays. An inactive gas for a gas discharge is injected into a discharge space defined between the upper and lower substrate 62 and 68 and the barrier rib 72. As shown in FIG. 5, a black matrix 80 is formed between the first electrode 76T and the third electrode 76Z which are provided at the adjacent discharge cells.

A hole 82 is defined at an intersection between the address electrode 78X and the first electrode 76T. Such a hole 82 is formed by removing the fluorescent layers 74R, 74G and 74B provided on the address electrode 78X. Accordingly, the address electrode 78X and the first electrode 76T are opposed to each other with having an dielectric layer 70 therebetween. Herein, a width of the hole 82 is larger than that of the address electrode 78X. For example, the hole 82 can be formed by removing the fluorescent layers 74R, 74G and 74B extending from an intersection between the address electrode 78X and the first electrode 76T into the adjacent barrier rib 72.

In the reset period of the PDP according to the embodiment of the present invention, a reset pulse is applied to any one of the first to third electrodes 76T, 76Y and 76Z. In the address period, a scanning pulse is applied to the first electrode 76T and a data pulse is applied to the address electrode 78X, to thereby cause an address discharge between the first electrode 76T and the address electrode 78X. Upon address discharge, wall charges are formed at upper and lower dielectric layers 64 and 70. In the sustain period, a sustain pulse is alternately applied to the second electrode 76Y and the third electrode 76Z to thereby generate a sustain discharge at the two electrodes 76Y and 76Z.

In the present embodiment, the hole 82 is formed, that is, the fluorescent body is not formed between the first electrode 76T and the address electrode 78X that cause an address discharge, so that an uniform address discharge can be generated irrespectively of dielectric constants of the fluorescent layers 74R, 74G and 74B. Furthermore, the fluorescent layers 74R, 74G and 74B defined between the second electrode 76Y and the third electrode 76Z that cause a sustain discharge are not removed, so that it is possible to prevent a deterioration of light-emission efficiency caused by such a formation of the hole 82. In other words, in the PDP according to the embodiment of the present invention, a uniform address discharge can be generated at all the discharge cells without any deterioration of light-emission efficiency. Moreover, all the discharge cells generate a uniform address discharge to prevent an erroneous discharge in the sustain period.

In the mean time, in the present embodiment shown in FIG. 4, the hole 82 is defined only at an intersection between the first electrode 76T and the address electrode 78X. Otherwise, the hole 84 may be defined such that it overlaps with an intersection between the first electrode 76T and the address electrode 78X as well as with the black matrix 80 being adjacent to the first electrode 76T. Such a hole 84 is formed in parallel to the address electrode 78X and is set to have a larger width than the address electrode 78X.

Figure 6:
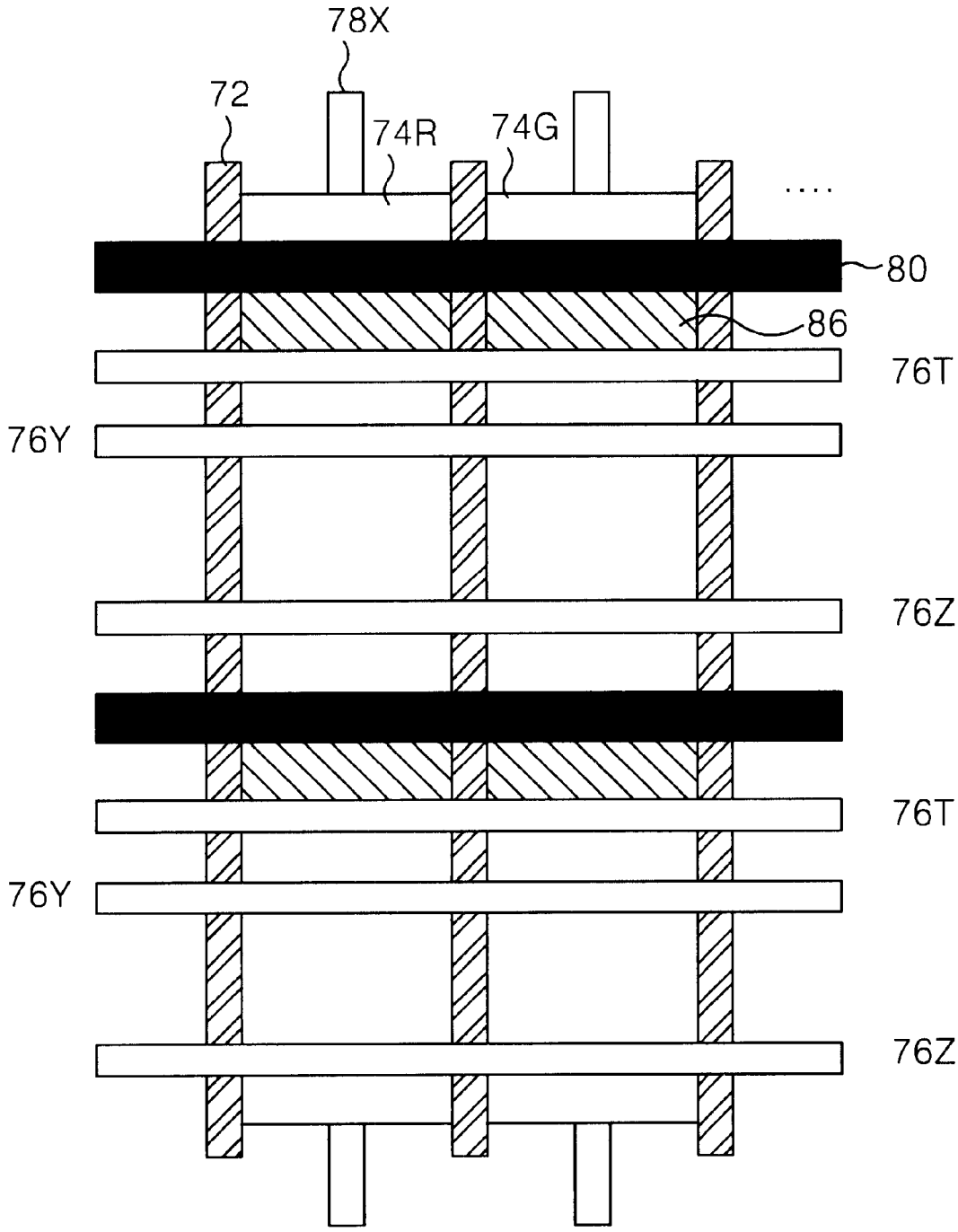
FIG. 6 illustrates another example of the hole shown in FIG. 4.

Alternatively, in the present invention, a hole 86 may be formed by removing a fluorescent body between barrier ribs 72 being adjacent to each other as shown in FIG. 6. Such a hole 86 is defined such that it overlaps with a black matrix 80 at an intersection between the first electrode 76T and the address electrode 78X.

Figure 7:
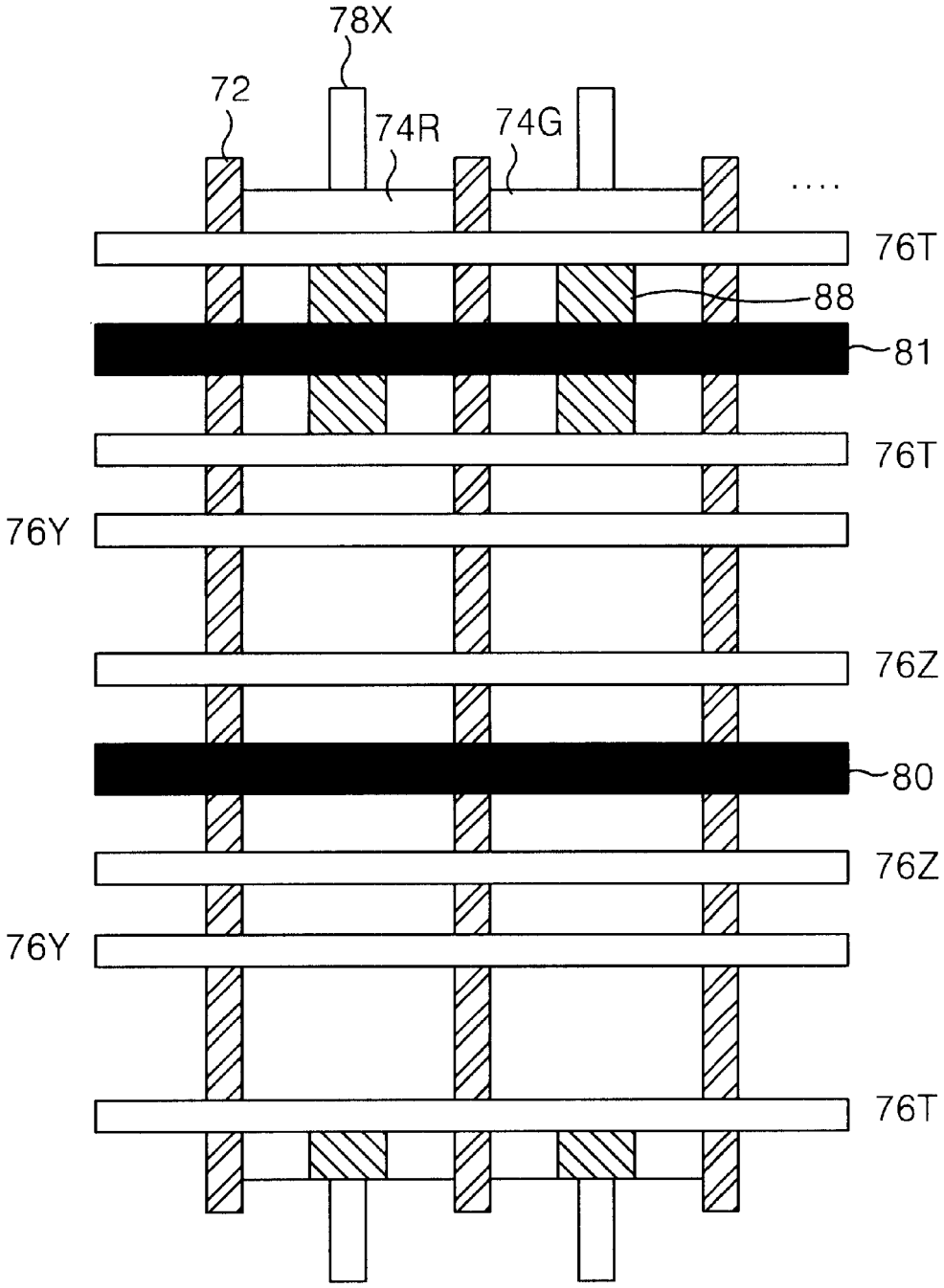
FIG. 7 is a perspective view showing a four-electrode AC surface-discharge plasma display panel according to another embodiment of the present invention.

Referring to FIG. 7, there is shown a plasma display panel according to another embodiment of the present invention.

Electrodes 76T, 76Y and 76Z of the PDP according to another embodiment of the present invention are arranged in a mirror type around black matrices 80 and 81. Thus, the same electrodes are arranged with having the black matrices 80 and 81 therebetween. In other words, the third electrodes 76Z are formed adjacently with having the first black matrix 80 therebetween while the first electrodes 76T are formed adjacently with having the second black matrix 81 therebetween.

In the reset period of the PDP according to another embodiment of the present invention, a reset pulse is applied to any one of the first to third electrodes 76T, 76Y and 76Z to cause a reset discharge within the discharge cell. In the address period, a scanning pulse is applied to the first electrode 76T and a data pulse is applied to the address electrode 78X, to thereby cause an address discharge between the first electrode 76T and the address electrode 78X. Upon address discharge, wall charges are formed at upper and lower dielectric layers (not shown). In the sustain period, a sustain pulse is alternately applied to the second electrode 76Y and the third electrode 76Z to thereby generate a sustain discharge at the two electrodes 76Y and 76Z.

In another embodiment of the present invention, a hole 88 is defined from an intersection between the first electrodes 76T being adjacent to each other with having the second black matrix 81 and the address electrode 78X until the second black matrix 81. In other words, the hole 88 is defined from an intersection between the first electrode 76T and the address electrode 78 formed at a specific discharge cell until the first electrode 76T formed adjacently with having the black matrix 80 therebetween. The hole 88 is defined such that it overlaps with the address electrode 78X and is parallel to the address electrode 78X. The hole 88 is set to have a larger width than the address electrode 78X. Such a hole 82 may be formed only at an intersection between the first electrode 76T and the address electrode 78X as shown in FIG. 4.

Figure 8:
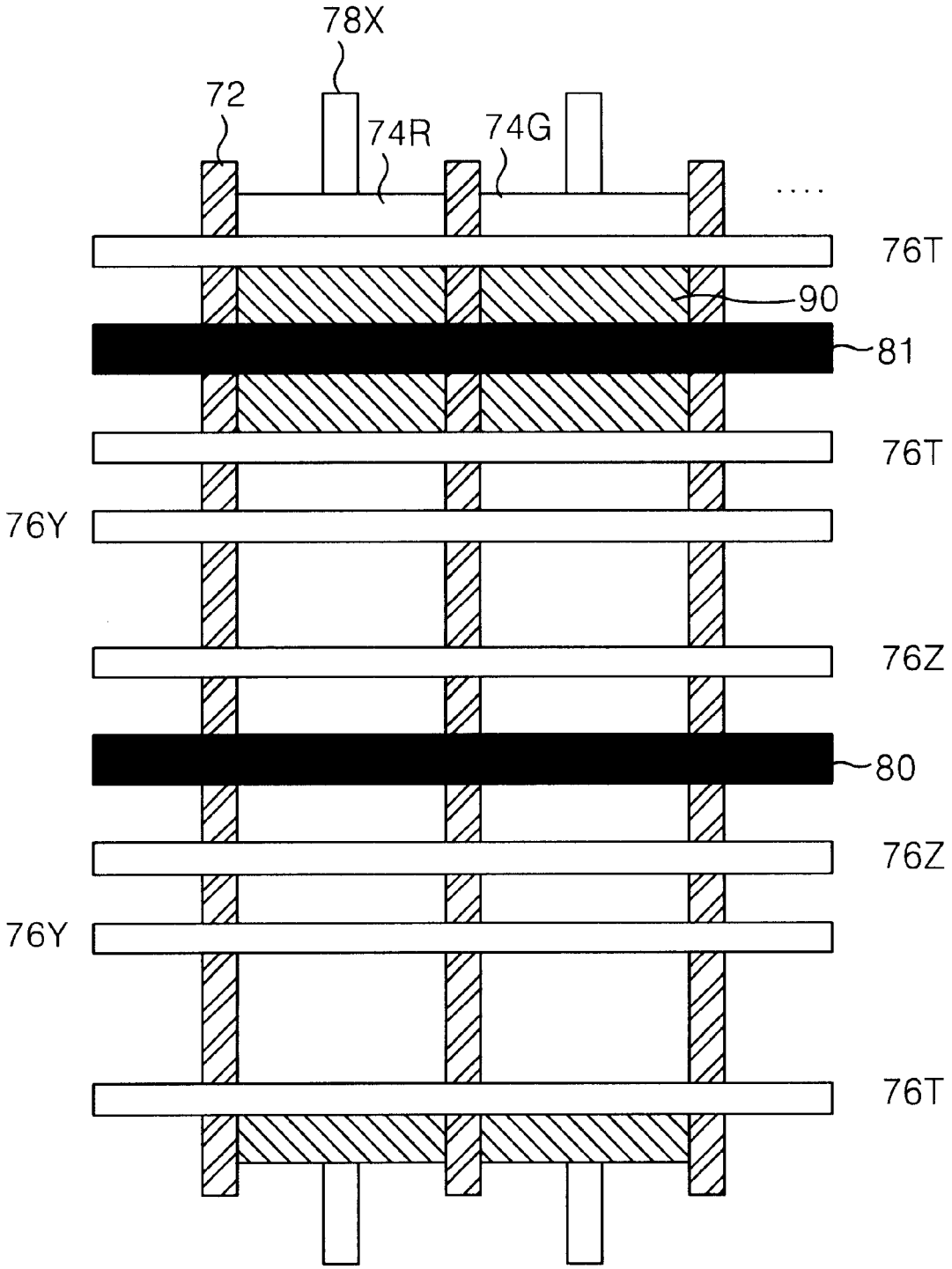
FIG. 8 illustrates another example of the hole shown in FIG. 7.

Alternatively, in another embodiment of the present invention, a hole 90 may be formed by removing a fluorescent body between barrier ribs 72 being adjacent to each other as shown in FIG. 8. Such a hole 86 is defined such that it overlaps with a black matrix 80 at an intersection between the first electrode 76T and the address electrode 78X.

As described above, according to the present invention, a fluorescent body is not formed at an intersection between the first electrode and the address electrode that cause an address discharge, so that uniform wall charges can be formed upon address discharge. In other words, an address discharge can be generated irrespectively of a dielectric constant of the fluorescent body. Furthermore, according to the present invention, a fluorescent layer formed between the second electrode and the third electrode that cause a sustain discharge is not removed. Accordingly, a sustain discharge is caused by utilizing uniform wall charges formed by the address discharge, it becomes possible to enhance a discharge efficiency.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a plurality of electrode groups, each of which includes first and second electrodes formed adjacently to each other at an upper substrate and third electrodes having a large distance from the second electrodes;

a plurality of address electrodes formed at a lower substrate in a direction crossing the first to third electrodes;

barrier ribs provided to form a discharge space between the upper substrate and the lower substrate;

a dielectric layer provided on the address electrode;

a first area including a fluorescent layer formed on the dielectric layer; and a second area other than the first area.

2. The plasma display panel as claimed in claim 1, wherein the second area is positioned at an intersection between the address electrode and the first electrode.

3. The plasma display panel as claimed in claim 2, wherein the second area has a larger width than the address electrode.

4. The plasma display panel as claimed in claim 2, wherein the second area is defined from an intersection between the address electrode and the first electrode until the barrier ribs formed adjacently to the address electrode.

5. The plasma display panel as claimed in claim 1, wherein a black matrix is formed between the electrode groups.

6. The plasma display panel as claimed in claim 5, wherein the second area is defined from an intersection between the address electrode and the first electrode until the black matrix formed adjacently to the first electrode.

7. The plasma display panel as claimed in claim 6, wherein the second area has a larger width than the address electrode.

8. The plasma display panel as claimed in claim 6, wherein the second area is defined from an intersection between the address electrode and the first electrode until the barrier ribs formed adjacently to the address electrode.

9. The plasma display panel as claimed in claim 1, wherein a data pulse is applied to the address electrode and a scanning pulse is applied to the first electrode in an address period for selecting a cell to be turned.

10. The plasma display panel as claimed in claim 9, wherein a sustain pulse is alternately applied to the second electrode and the third electrode in a sustain period for discharging cells selected in the address period.

11. The plasma display panel as claimed in claim 1, wherein the fluorescent material is not formed at the second area.

12. A plasma display panel, comprising:

a plurality of first electrode groups, each of which includes first and second electrodes formed adjacently to each other at an upper substrate and third electrodes having a large distance from the second electrodes;

a plurality of second electrode groups being adjacent to the first electrode groups and having first electrodes, second electrodes and third electrodes arranged in a mirror type with respect to the first electrode groups;

a plurality of address electrodes formed at a lower substrate in a direction crossing the first to third electrodes;

barrier ribs provided to form a discharge space between the upper substrate and the lower substrate;

a dielectric layer provided on the address electrode;

a first area including a fluorescent layer formed on the dielectric layer; and a second area other than the first area.

13. The plasma display panel as claimed in claim 12, wherein the second area is positioned at an intersection between the address electrode and the first electrode.

14. The plasma display panel as claimed in claim 13, wherein the second area has a larger width than the address electrode.

15. The plasma display panel as claimed in claim 13, wherein the second area is defined from an intersection between the address electrode and the first electrode until the barrier ribs formed adjacently to the address electrode.

16. The plasma display panel as claimed in claim 12, wherein a black matrix is formed between the first and second electrode groups.

17. The plasma display panel as claimed in claim 16, wherein the second area is positioned between the first electrodes formed adjacently with having the black matrix therebetween.

18. The plasma display panel as claimed in claim 17, wherein the second area has a larger width than the address electrode.

19. The plasma display panel as claimed in claim 17, wherein the second area is defined from an intersection between the address electrode and the first electrode until the barrier ribs formed adjacently to the address electrode.

20. The plasma display panel as claimed in claim 12, wherein a data pulse is applied to the address electrode and a scanning pulse is applied to the first electrode in an address period for selecting a cell to be turned.

21. The plasma display panel as claimed in claim 20, wherein a sustain pulse is alternately applied to the second electrode and the third electrode in a sustain period for discharging cells selected in the address period.

22. The plasma display panel as claimed in claim 12, wherein the fluorescent material is not formed at the second area.

* * * * *